US010077686B2

(12) United States Patent
Baltrucki et al.

(10) Patent No.: US 10,077,686 B2
(45) Date of Patent: Sep. 18, 2018

(54) PUSHROD ASSEMBLY

(71) Applicant: Jacobs Vehicle Systems, Inc., Bloomfield, CT (US)

(72) Inventors: Justin Baltrucki, Canton, CT (US); G. Michael Gron, Granby, CT (US); Dong Yang, West Hartford, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 64 days.

(21) Appl. No.: 14/800,092

(22) Filed: Jul. 15, 2015

(65) Prior Publication Data

US 2016/0017764 A1 Jan. 21, 2016

Related U.S. Application Data

(60) Provisional application No. 62/024,629, filed on Jul. 15, 2014.

(51) Int. Cl.
*F01L 1/24* (2006.01)
*F01L 1/14* (2006.01)
(Continued)

(52) U.S. Cl.
CPC ..... *F01L 1/146* (2013.01); *F01L 1/18* (2013.01); *F01L 1/46* (2013.01); *F01L 9/02* (2013.01);
(Continued)

(58) Field of Classification Search
CPC ..... F01L 1/146; F01L 1/18; F01L 1/2422
(Continued)

(56) References Cited

U.S. PATENT DOCUMENTS 2,385,959 A * 10/1945 Yingling ..... F01L 1/26 123/90.22
2,677,358 A * 5/1954 Wright ..... F01L 1/146 123/90.62
(Continued)

FOREIGN PATENT DOCUMENTS

JP 60169609 A 9/1985
JP H0617608 A 1/1994
(Continued)

OTHER PUBLICATIONS

International Search Report and Written Opinion recieved in PCT/US2015/040563; dated Oct. 21, 2015; 12 pgs.
(Continued)

*Primary Examiner* — Jorge Leon, Jr.
(74) *Attorney, Agent, or Firm* — Moreno IP Law LLC

(57) ABSTRACT

A pushrod assembly for an internal combustion engine comprises a pushrod having a first end and a second end, the first end being configured to receive valve actuation motions from a valve actuation motion source and the second end being configured to impart the valve actuation motions to a valve train component. The pushrod includes a resilient element engagement feature. The pushrod assembly includes a fixed support and a resilient element operatively connected to the resilient element engagement feature and the fixed support. The resilient element is configured to bias the pushrod, via the resilient element engagement feature, toward the valve actuation motion source. An internal combustion engine may comprise the pushrod assembly described herein. A follower assembly may be provided to maintain contact between second end of the pushrod and the valve train component.

15 Claims, 6 Drawing Sheets

(51) Int. Cl.

| | |
|---|---|
| ***F01L 1/18*** | (2006.01) |
| ***F01L 1/46*** | (2006.01) |
| ***F01L 9/02*** | (2006.01) |
| ***F01L 13/06*** | (2006.01) |
| *F01L 1/26* | (2006.01) |
| *F01L 1/20* | (2006.01) |

(52) U.S. Cl.
CPC ..... *F01L 13/06* (2013.01); *F01L 13/065* (2013.01); *F01L 1/181* (2013.01); *F01L 1/20* (2013.01); *F01L 1/2422* (2013.01); *F01L 1/26* (2013.01); *F01L 2800/10* (2013.01)

(58) Field of Classification Search
USPC ..... 123/90.39, 90.46
See application file for complete search history.

(56) References Cited

U.S. PATENT DOCUMENTS

| | | | | |
|---|---|---|---|---|
| 2,743,712 | A * | 5/1956 | Hulsing | F01L 1/146 123/90.61 |
| 2,927,566 | A * | 3/1960 | Moye | F01L 1/146 123/90.61 |
| 3,273,546 | A * | 9/1966 | Von Arx | F01L 1/12 123/90.15 |
| 3,518,976 | A * | 7/1970 | Thuesen | F01L 1/146 123/90.16 |
| 3,585,974 | A * | 6/1971 | Weber | F01L 1/026 123/90.12 |
| 3,786,792 | A * | 1/1974 | Pelizzoni | F01L 1/2422 123/321 |
| 3,964,455 | A * | 6/1976 | Brown | F01L 1/2422 123/90.16 |
| 4,602,597 | A * | 7/1986 | Rhoads | F01L 13/0031 123/90.15 |
| 4,892,067 | A * | 1/1990 | Paul | F01L 1/26 123/90.12 |
| 5,327,858 | A * | 7/1994 | Hausknecht | F01L 1/146 123/90.12 |
| 5,347,965 | A * | 9/1994 | Decuir | F01L 1/12 123/90.61 |
| 5,546,899 | A | 8/1996 | Sperling et al. | |
| 5,732,670 | A | 3/1998 | Mote, Sr. | |
| 6,234,143 | B1 | 5/2001 | Bartel et al. | |
| 7,509,933 | B2 * | 3/2009 | Dingle | F01L 1/181 123/90.39 |
| 7,673,600 | B2 | 3/2010 | Yang | |
| 7,905,208 | B2 | 3/2011 | Ruggiero et al. | |
| 8,578,901 | B2 | 11/2013 | Ruggiero et al. | |
| 2002/0121255 | A1 * | 9/2002 | Speil | F01L 1/146 123/90.52 |
| 2010/0319657 | A1 | 12/2010 | Dodi et al. | |
| 2011/0271923 | A1 * | 11/2011 | Schnell | F01L 1/181 123/90.46 |
| 2013/0306015 | A1 * | 11/2013 | Kawahara | F01M 9/00 123/90.36 |
| 2013/0306016 | A1 * | 11/2013 | Kato | F01L 1/18 123/90.45 |

FOREIGN PATENT DOCUMENTS

| | | | |
|---|---|---|---|
| JP | H09280015 | A | 10/1997 |
| WO | 2005089274 | A2 | 9/2005 |
| WO | 2010141633 | A1 | 9/2010 |

OTHER PUBLICATIONS

Extended European search report for European Patent Application No. 15822488, dated Feb. 16, 2018, 6 pages.

* cited by examiner

- PRIOR ART -

- PRIOR ART -

PUSHROD ASSEMBLY

CROSS-REFERENCE TO RELATED APPLICATION

The instant application claims the benefit of Provisional U.S. Patent Application Ser. No. 62/024,629 entitled "Valve Bridge With Integrated Lost Motion System" and filed Jul. 15, 2014, the teachings of which are incorporated herein by this reference.

The instant application is also related to co-pending U.S. patent application Ser. No. 14/799,813, entitled "Bias Mechanisms For A Rocker Arm And Lost Motion Component Of A Valve Bridge", and to co-pending U.S. patent application Ser. No. 14/799,837, entitled "System Comprising An Accumulator Upstream Of A Lost Motion Component In A Valve Bridge", both filed on even date herewith.

FIELD

The instant disclosure relates generally to actuating one or more engine valves in an internal combustion engine and, in particular, to valve actuation including a lost motion system.

BACKGROUND

As known in the art, valve actuation in an internal combustion engine controls the production of positive power. During positive power, intake valves may be opened to admit fuel and air into a cylinder for combustion. One or more exhaust valves may be opened to allow combustion gas to escape from the cylinder. Intake, exhaust, and/or auxiliary valves may also be controlled to provide auxiliary valve events, such as (but not limited to) compression-release (CR) engine braking, bleeder engine braking, exhaust gas recirculation (EGR), internal exhaust gas recirculation (IEGR), brake gas recirculation (BGR) as well as so-called variable valve timing (VVT) events such as early exhaust valve opening (EEVO), late intake valve opening (LIVO), etc.

As noted, engine valve actuation also may be used to produce engine braking and exhaust gas recirculation when the engine is not being used to produce positive power. During engine braking, one or more exhaust valves may be selectively opened to convert, at least temporarily, the engine into an air compressor. In doing so, the engine develops retarding horsepower to help slow a vehicle down. This can provide the operator with increased control over the vehicle and substantially reduce wear on the service brakes of the vehicle.

One method of adjusting valve timing and lift, particularly in the context of engine braking, has been to incorporate a lost motion component in a valve train linkage between the valve and a valve actuation motion source. In the context of internal combustion engines, lost motion is a term applied to a class of technical solutions for modifying the valve motion dictated by a valve actuation motion source with a variable length mechanical, hydraulic or other linkage assembly. In a lost motion system the valve actuation motion source may provide the maximum dwell (time) and greatest lift motion needed over a full range of engine operating conditions. A variable length system may then be included in the valve train linkage between the valve to be opened and the valve actuation motion source to subtract or "lose" part or all of the motion imparted from the valve actuation motion source to the valve. This variable length system, or lost motion system may, when expanded fully, transmit all of the available motion to the valve and when contracted fully transmit none or a minimum amount of the available motion to the valve.

An example of such a valve actuation system 100 comprising a lost motion component is shown schematically in FIG. 1. The valve actuation system 100 includes a valve actuation motion source 110 operatively connected to a rocker arm 120. The rocker arm 120 is operatively connected to a lost motion component 130 that, in turn, is operatively connected to one or more engine valve(s) 140 that may comprise one or more exhaust valves, intake valves, or auxiliary valves. The valve actuation motion source 110 is configured to provide opening and closing motions that are applied to the rocker arm 120. The lost motion component 130 may be selectively controlled such that all or a portion of the motion from the valve actuation motion source 110 is transferred or not transferred through the rocker arm 120 to the engine valve(s) 140. The lost motion component 130 may also be adapted to modify the amount and timing of the motion transferred to the engine valve(s) 140 in accordance with operation of a controller 150. As known in the art, valve actuation motion source 110 may comprise any combination of valve train elements, including, but not limited to, one or more: cams, push tubes or pushrods, tappets or their equivalents. As known in the art, the valve actuation motion source 110 may be dedicated to providing exhaust motions, intake motions, auxiliary motions or a combination of exhaust or intake motions together with auxiliary motions.

The controller 150 may comprise any electronic (e.g., a microprocessor, microcontroller, digital signal processor, co-processor or the like or combinations thereof capable of executing stored instructions, or programmable logic arrays or the like, as embodied, for example, in an engine control unit (ECU)) or mechanical device for causing all or a portion of the motion from the valve actuation motion source 110 to be transferred, or not transferred, through the rocker arm 120 to the engine valve(s) 140. For example, the controller 150 may control a switched device (e.g., a solenoid supply valve) to selectively supply hydraulic fluid to the rocker arm 120. Alternatively, or additionally, the controller 150 may be coupled to one or more sensors (not shown) that provide data used by the controller 150 to determine how to control the switched device(s). Engine valve events may be optimized at a plurality of engine operating conditions (e.g., speeds, loads, temperatures, pressures, positional information, etc.) based upon information collected by the controller 150 via such sensors.

Where the lost motion component 130 is hydraulically actuated, the supply of the necessary hydraulic fluid is of critical importance to the successful operation of the valve actuation system 100. This is particularly true of so-called bridge brake systems in which the lost motion component 130 is supported by or deployed within a valve bridge (not shown) and hydraulic fluid for actuating the lost motion component 130 is supplied via the rocker arm 120. In the related U.S. patent application Ser. No. 14/799,813, structures are described for biasing the rocker arm 120 and a valve bridge-based lost motion component 130 into contact with each other, particularly in systems in which the rocker arm 130 is biased into contact with the valve actuation motion source 110, which, as noted above, may include a pushrod-based valve train. As known in the art, pushrod-type engines have valve trains with comparatively large reciprocating mass and it is necessary to maintain contact between the pushrod and valve actuation motion source, e.g., a cam or cam follower. Consequently, the forces required to control the pushrod motion are often higher than can be reasonably provided by systems that bias the rocker arm against the pushrod, i.e., the valve actuation motion source. Alternatively, where the rocker arm is biased toward a lost motion component in a valve bridge, excessive play or lash in the pushrod-to-rocker arm, or pushrod-to-cam follower interface leads to noise, impact loading, etc.

In order to maintain contact between a pushrod and its corresponding valve actuation motion source, it is known to incorporate spring biasing into the pushrod itself, as illustrated in FIG. 2. As shown, a pushrod 202 includes a sliding member 204 in it, and a preloaded spring 206 expanding the assembly outwards. When assembled to the engine, the spring 206 pushes against the rocker arm, biasing it toward the engine valves, and also biases the pushrod 202 toward the valve actuation motion source. A particular disadvantage of such a configuration is that it creates a potentially high force against the engine valves, which may induce valve floating. This tendency to cause valve floating limits the force that can be provided by the bias spring in this arrangement.

SUMMARY

The instant disclosure describes a pushrod assembly for an internal combustion engine comprising a pushrod having a first end and a second end, the first end being configured to receive valve actuation motions from a valve actuation motion source and the second end being configured to impart the valve actuation motions to a valve train component. Furthermore, the pushrod comprises a resilient element engagement feature. The pushrod assembly further comprises a fixed support and a resilient element operatively connected to the resilient element engagement feature and the fixed support. The resilient element is further configured to bias the pushrod, via the resilient element engagement feature, toward the valve actuation motion source. In an embodiment, the resilient element engagement feature may be disposed proximally to the second end of the pushrod and, in another embodiment, the resilient element engagement feature may comprise a retainer affixed to the pushrod. The resilient element may comprise a coil spring surrounding the pushrod.

An internal combustion engine may comprise the pushrod assembly described herein. A follower assembly may be provided to maintain contact between second end of the pushrod and the valve train component, where the follower assembly comprises a sliding member operatively connected to a sliding member resilient element that, in turn, is configured to bias the sliding member toward the pushrod. The sliding member may be disposed within a bore formed in the valve train component and the sliding member resilient element may be operatively connected to the valve train component. The valve train component may comprise a first contact surface and the sliding member may comprise a second contact surface complementary to the first contact surface such that engagement of the first and second contact surface permits the valve actuation motions to be conveyed to the valve train component. In another embodiment, the follower assembly may further comprise an adjustable housing disposed within the bore and having its own internal bore, wherein the sliding member is disposed within the internal bore and the sliding member resilient element is operatively connected to the adjustable housing. In this embodiment, the adjustable housing may comprise the first contact surface configured to mate with the second contact surface formed on the sliding member. In yet another embodiment, the valve train component is a rocker arm.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 3:
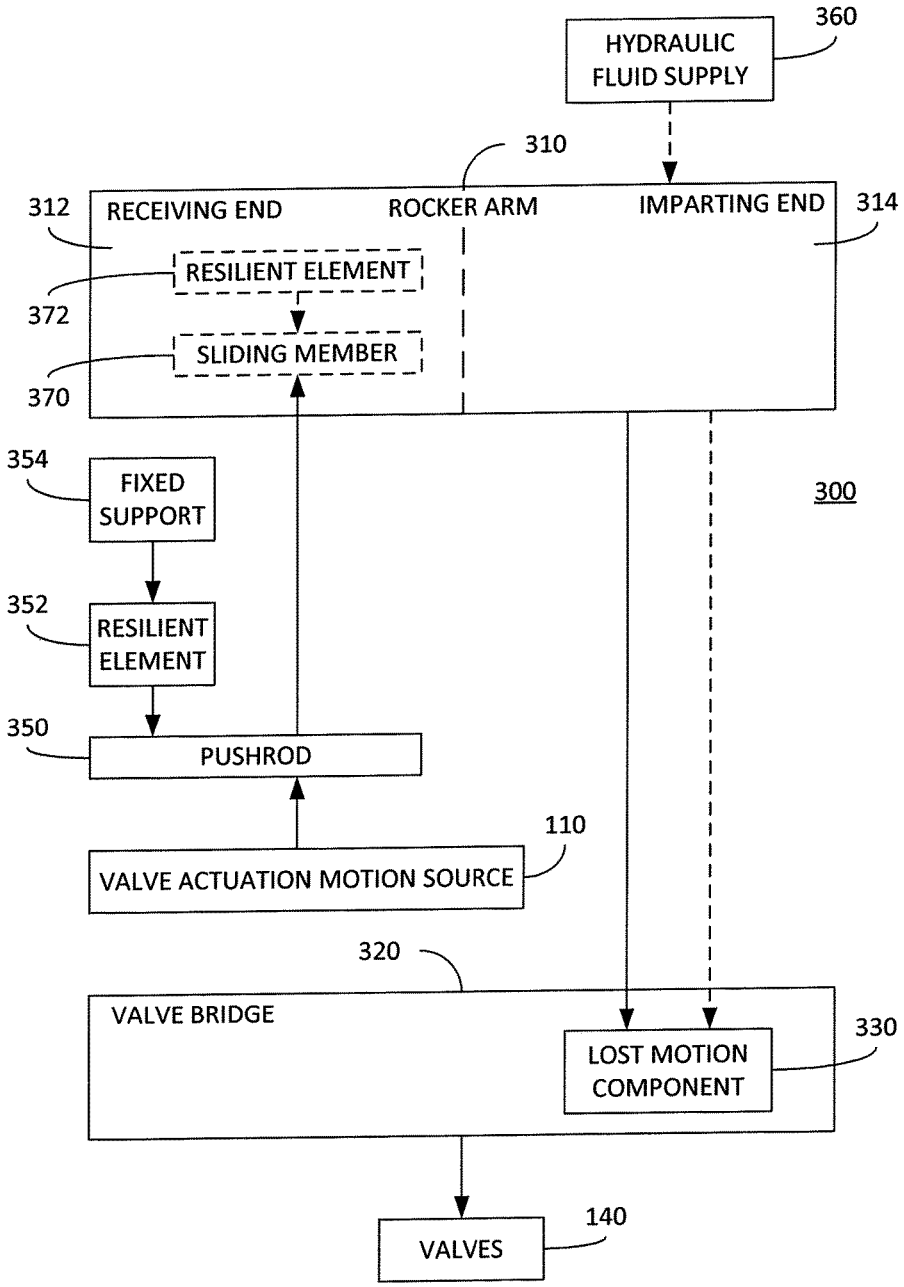
FIG. 3 is a block diagram schematically illustrating a valve actuation system in accordance with the instant disclosure.

Referring now to FIG. 3, a valve actuation system 300 in accordance with the instant disclosure is illustrated. As shown, the system 300 comprises a valve actuation motion source 110, as described above, operatively connected to a motion receiving end 312 of a rocker arm 310. The rocker arm 310 also comprises a motion imparting end 314. The system 300 further comprises a valve bridge 320 operatively connected to the two or more engine valves 140. As known in the art of bridge brake systems, the valve bridge 320 may comprise a lost motion component 330.

Though not illustrated in FIG. 3, the rocker arm 310 is typically supported by a rocker arm shaft and the rocker arm 310 reciprocates about the rocker arm shaft. Also, as known in the art, the rocker arm shaft may incorporate elements of a[[n]] hydraulic fluid supply 360 in the form of hydraulic fluid passages formed along the length of the rocker arm shaft. As further known in the art, the motion receiving end 312 may comprise any of a number of suitable configurations depending on the nature of the valve actuation motion source 110. For example, where the valve actuation motion source 110 comprises a cam, the motion receiving end 312 may comprise a cam roller. Alternatively, where the valve actuation motion source 110 comprises a push tube or pushrod, the motion receiving end 312 may comprise a suitable receptacle surface configured to receive the end of the push tube. The instant disclosure is not limited in this regard.

As shown, the motion imparting end 314 of the rocker arm 310 conveys valve actuation motions (solid arrows) provided by the valve actuation motion source 110 to the lost motion component 330 of the valve bridge 320. Though not shown in FIG. 3, one or more hydraulic passages are provided in the motion imparting end 314 of the rocker arm 310 such that hydraulic fluid (dotted arrows) received from the hydraulic fluid supply 360 may also be conveyed to the lost motion component 330 via the motion imparting end 314.

The valve bridge 320 operatively connects to two or more engine valves 140 that, as noted previously, may comprise intake valves, exhaust valves and/or auxiliary valves, as known in the art. The lost motion component 330 is supported by the valve bridge 320 and is configured to receive the valve actuation motions and hydraulic fluid from the motion imparting end 314 of the rocker arm 310. The lost motion component 330 is hydraulically-actuated in the sense that the supply of hydraulic fluid causes the lost motion component 330 to either assume a state in which the received valve actuation motions are conveyed to the valve bridge 320 and, consequently, the valves 140, or a state in which the received valve actuation motions are not conveyed to the valve bridge 320 and are therefore "lost." An example of a lost motion component in a valve bridge is taught in U.S. Pat. No. 7,905,208, the teachings of which are incorporated herein by this reference, in which valve actuation motions from the rocker arm are lost when hydraulic fluid is not provided to the lost motion component, but are conveyed to the valve bridge and valves when hydraulic fluid is provided to the lost motion component. In lost motion components 330 of this type, a check valve (not shown) is provided to permit one-way flow of hydraulic fluid into the lost motion component 330. The check valve permits the lost motion component 330 to establish a locked volume of hydraulic fluid that, due to the substantially incompressible nature of the hydraulic fluid, allows the lost motion component 330 to operate in substantially rigid fashion thereby conveying the received valve actuation motions.

As further illustrated in the embodiment of FIG. 3, valve actuation motions provided by the valve actuation motion source 110 are conveyed to the motion receiving end 312 of the rocker arm 310 by a pushrod 350 that comprises a first end configured to receive the valve actuation motions from the valve actuation motion source 110, and a second end configured to impart the valve actuation motions to the motion receiving end 312. For example, as known in the art, the first end of the pushrod 350 may comprise a connector or contact surface for interfacing with a cam follower or tappet. Likewise, the second end of the pushrod 350 may comprise a receptacle or socket configured to receive a corresponding ball or spherical projection from the rocker arm 310. The instant disclosure is not limited with regard to the specific configuration of the first and second ends of the pushrod 350.

It is noted that the rocker arm 310 is a specific implementation of a valve train component that receives valve actuation motions from the valve actuation motion source 110. As those skilled in the art will appreciate, other types of valve train components may be used to receive the valve actuation motions. For example, a tappet may be positioned as an intervening element between the pushrod 350 and the rocker arm 310. Thus, where reference is made herein to a rocker arm as receiving the valve actuation motions from a pushrod, it is understood that a more generalized valve train component of the types known in the art may be equally employed.

In an embodiment, the pushrod 350 comprises a resilient element engagement feature configured to be operatively connected to a resilient element 352. For example, the resilient element engagement feature may comprise an opening, indentation, protuberance, shoulder, etc. integrally formed in the pushrod 350 capable of receiving, and conveying to the pushrod 350, bias force provided by the resilient element 352. Alternatively, the resilient element engagement feature may comprise a component that is affixed to, but not otherwise integrally formed in, the pushrod 350, an example of which is further described below. The resilient element 352 may comprise any of a variety of springs (such as compression or tension springs in the form of coil or flat springs, etc.) or equivalents thereof.

As further shown in FIG. 3, the resilient element is 352 is operatively connected to a fixed support 354. The fixed support 354 provides an unyielding reaction surface for the resilient element 352 to push against. In this manner, the resilient element 352 can be selected to provide sufficient bias force to maintain contact between the pushrod 350 and valve actuation motion source 110 without providing similar loading on the rocker arm 310 and, consequently, the valve bridge 320 and engine valves 140 as would be the case of the prior art pushrod illustrated in FIG. 2. As a further result, biasing of the rocker arm 310 toward either the valve bridge 320 or toward the pushrod 350 may be accomplished with a relatively light spring, thereby reducing the loads placed on either the valve bridge 320, engine valves 140 or lost motion component 330, in the former case, or against the pushrod 350 and valve actuation motion source 110, in the latter case. The fixed support 354 may be integrally formed in or rigidly attached to a suitably stationary body relative to the reciprocal motion of the pushrod 350, such as an engine block or cylinder overhead.

As alluded to above, in some embodiments, it may be desirable to bias the rocker arm 310 into contact with the valve bridge 320, particularly in order to ensure proper flow of hydraulic fluid from the motion imparting end 314 of the rocker arm 310 to the lost motion component 330 of the valve bridge 320. This problem can be even more pronounced where the above-described pushrod assembly (i.e. pushrod 350, resilient element 352 and fixed support 354), as described above, biases the pushrod 350 away from the pushrod/rocker arm interface. Consequently, lash or gaps may be present between the motion receiving end 312 of the rocker arm 310 and the pushrod 350, which in turn could result in noise, undesirable impact loading or possible dislodgement of ball/socket joints between the rocker arm 310 and pushrod 350. To avoid such lash, as the potential problems that may result, the rocker arm 310 may be equipped with a follower assembly comprising a sliding member 370 that is biased into contact with the pushrod 350 by a corresponding sliding member resilient element 372. Various embodiments of pushrod and follower assemblies in accordance with the instant disclosure are further illustrated and described below with respect to FIGS. 4-7.

Figure 4:
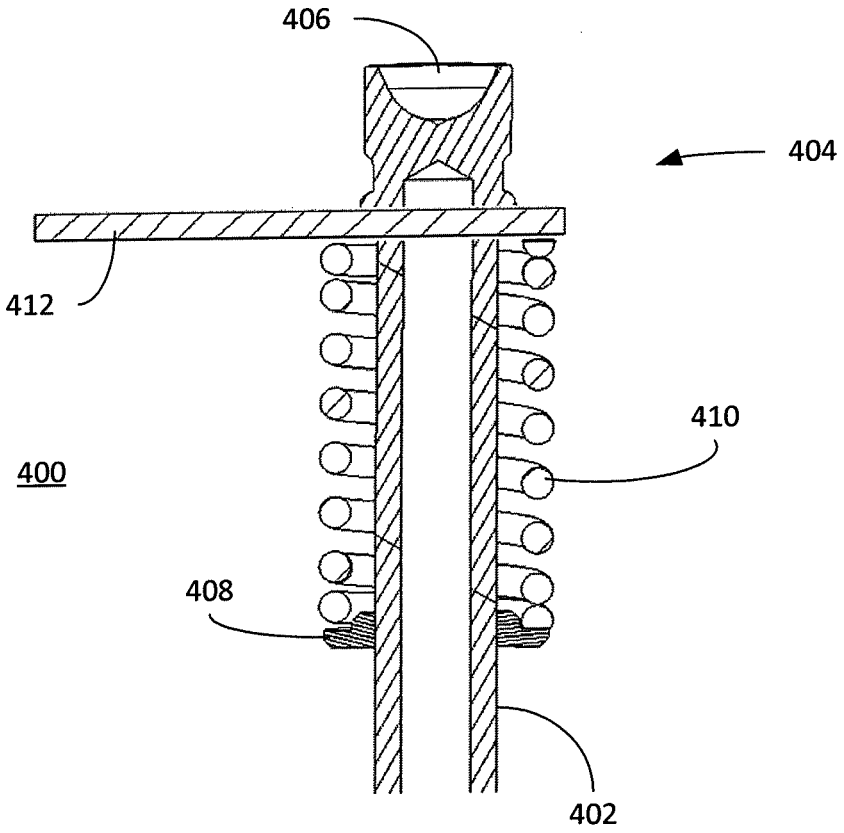
FIG. 4 is a cross-sectional illustration of a pushrod assembly in accordance with the instant disclosure.

Referring now to FIG. 4, a pushrod assembly 400 in accordance with the instant disclosure is illustrated in cross-section. In particular, the assembly 400 comprises a pushrod 402 having a retainer 408, resilient element 410 and fixed support 412 disposed in proximity to a second end 404 of the pushrod 402. While the retainer 408, resilient element 410 and fixed support 412 are illustrated as being deployed proximally to the second end 404 of the pushrod 402, those of skill in the art will appreciate that this is not a requirement and that these components may be disposed elsewhere along the length of the pushrod 402. As further shown, the second end 404 comprises a receptacle or socket 406 configured to receive a ball or spherical projection from the valve train component, i.e., rocker arm, to which the second end 404 is operatively connected.

In the implementation of FIG. 4, the resilient element 410 comprises a coiled compression spring that surrounds the pushrod 402. The length of and bias force provided by the resilient element 410 may be selected as a matter of design choice according to the needs of the particular internal combustion engine in which it is deployed. The retainer 408, in this instance comprises a ring that is affixed to the pushrod 402 using conventional techniques, e.g., force fit, fastener, welding, etc. The fixed support 412 in this case comprises a horizontally-mounted bracket or cantilever. However, horizontal mounting of the fixed support 412 is not a requirement. More generally, the fixed support 412 should be substantially (i.e., within manufacturing tolerances) perpendicular to the longitudinal axis of the pushrod 402. The pushrod 402 may be disposed in an opening or channel (not shown) in the fixed support 412, which opening is sufficiently close in diameter to the diameter of the pushrod 402 but less than the diameter of the resilient element 410, thereby providing an immobile reaction surface for the resilient element 410. Alternatively, the fixed support 412 may pass through an opening in the pushrod 402, which opening is of sufficient length to accommodate the reciprocal motion of the pushrod 402.

Figure 5:
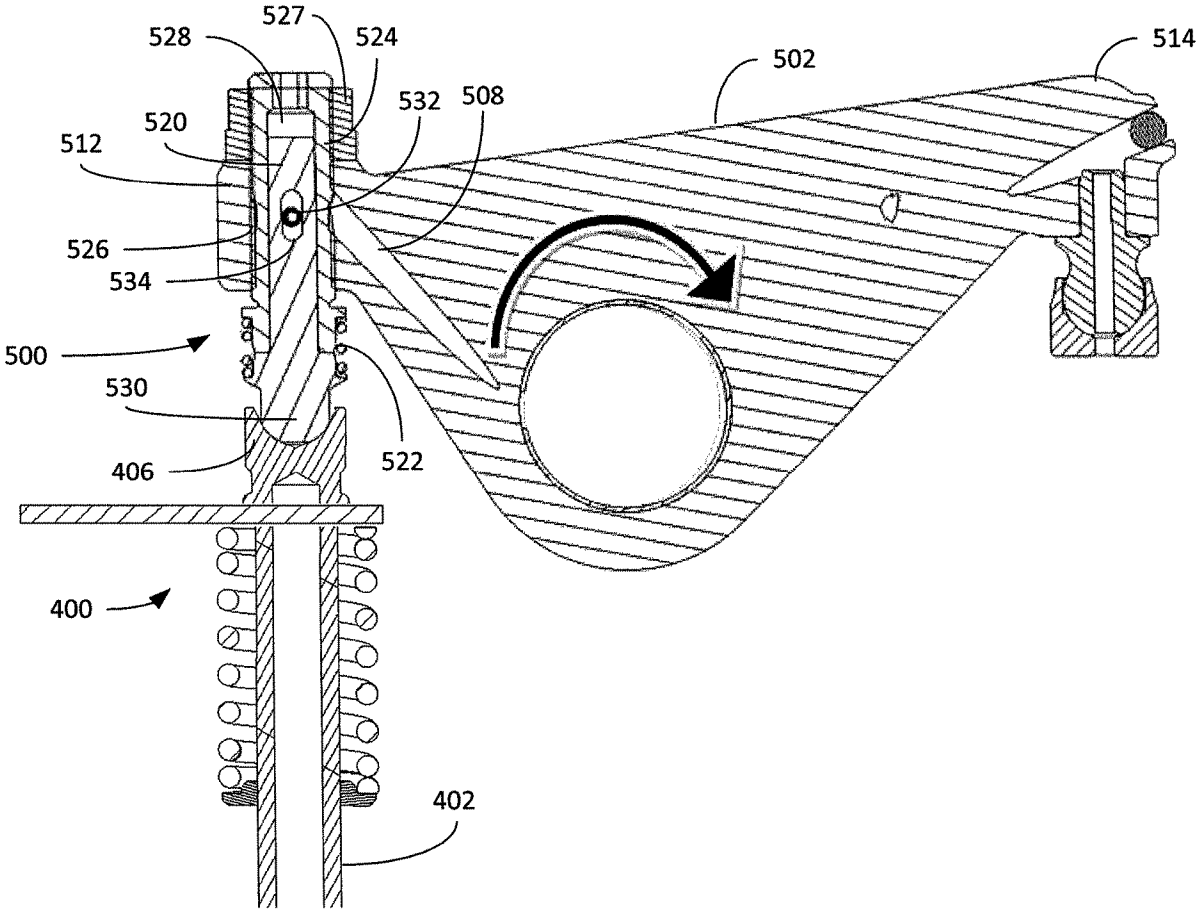
FIGS. 5 and 6 are cross-sectional illustrations of the pushrod assembly of FIG. 4 and a rocker arm having a follower assembly in accordance with the instant disclosure.
Figure 6:
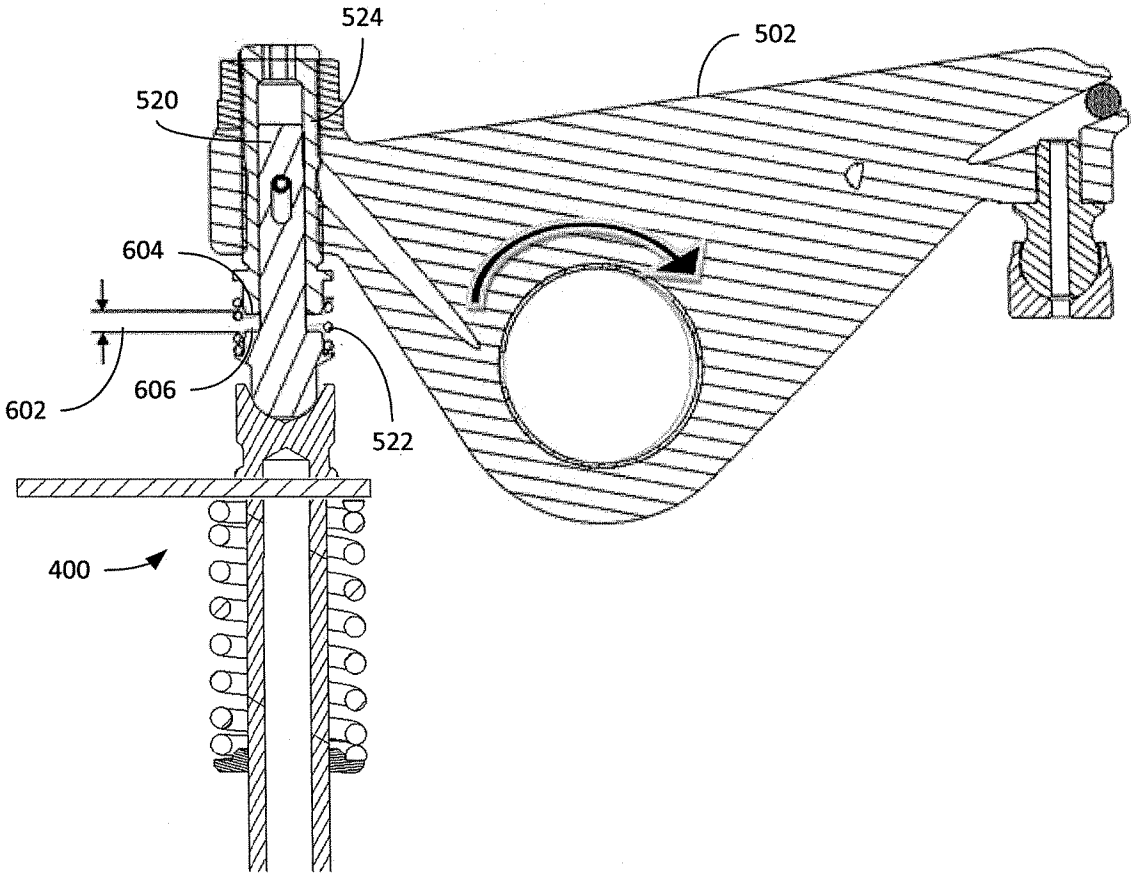

FIGS. 5 and 6 are cross-sectional views of the pushrod assembly 400 of FIG. 4 in conjunction with a follow assembly 500 disposed within a rocker arm 502. As described above, the rocker arm 502 comprises a motion receiving end 512 and a motion imparting end 514. The motion receiving end 512 of the rocker arm 502 comprises the follower assembly 500 that, in turn, comprises a sliding member 520 and sliding member resilient element 522. In the illustrated embodiment, the sliding member 520 is slidably disposed within an internal bore 528 formed in an adjustable housing 524 that is itself disposed within a bore 526 formed in the rocker arm 502. For example, the adjustable housing 524 may be slidably disposed within the bore 526 in order to accommodate desired lash settings (as known in the art) and maintained in a certain location with the bore 526 by a suitable lock nut 527 or the like. Although the sliding member 520 is illustrated in FIG. 5 as being slidably disposed within the internal bore 528, it will be appreciated by those skilled in the art that the adjustable housing 524 is not required. For example, the sliding member 520 could be slidably disposed directly in the bore 526 formed in the rocker arm 502. As further shown, the sliding member 520 comprises a ball or spherical projection 530 that rotatably engages the receptacle or socket 406 of the pushrod. Further, the components of the follower assembly 500 may be lubricated through a lubrication channel 508 formed in the rocker arm 502 and supplied with lubricating fluid using techniques known in the art, e.g., via fluid supply channels formed in a rocker shaft (not shown).

The sliding member resilient element 522, which may comprise any of the above-mentioned types of springs or the like, is operatively connected to the adjustable housing 524 (or rocker arm 502 if the adjustable housing 524 is not provided) and the sliding member 520 such that the sliding member is biased toward the pushrod assembly 400. As best shown in FIG. 6, the adjustable housing 524 may comprise a first contact surface 604 and the sliding member 520 may comprise a second contact surface 606. Once again, in those instances in which the adjustable housing 524 is not provided, the first contact surface 604 may be integrally formed in the rocker arm 502. The first and second contact surfaces 604, 606 are configured with complementary features, i.e., for mating engagement. As shown in FIG. 5, when the first and second contact surfaces 604, 606 are engaged, the adjustable housing 524 and sliding member 520 form a rigid assembly relative to valve actuation motions provided by the pushrod assembly 400, i.e., the valve actuation motions are conveyed to the rocker arm 502 through the rigid engagement of the first and second contact surfaces 604, 606.

Conversely, in those instances in which the rocker arm 502 rotates or is biased away from the pushrod assembly 400, as best shown in FIG. 6, the resilient element 522 biases the sliding member 520 toward the pushrod assembly 400. In this manner, lash space 602 that could otherwise arise between the ball 530 and socket 406 is accommodated by the adjustable housing 524 and sliding member 520. As shown, the follower assembly 500 may further comprise a limit pin 532 disposed within a limit channel 534 formed in the sliding member 520. As the limit pin 532 engages opposite ends of the limit channel 534, travel of the sliding pin 520 is limited by the length of the limit channel 534. As will be appreciated by those of skill in the art, other means for limiting the stroke length of the sliding member 520 may be equally employed.

Figure 7:
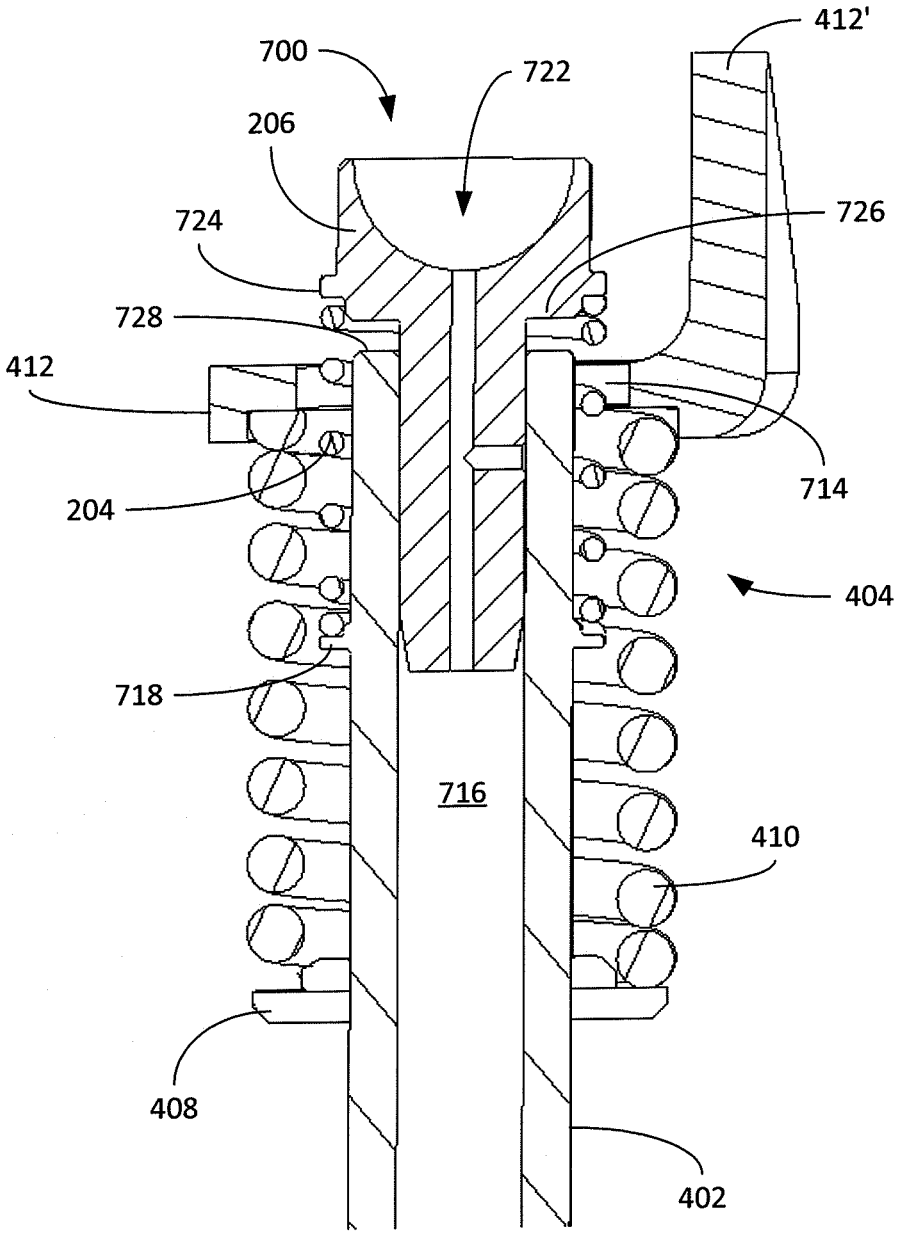
FIG. 7 is a cross-sectional illustration of a pushrod assembly in accordance with the instant disclosure in combination with a spring-loaded pushrod in accordance with FIG. 2.

As described above relative to FIGS. 5 and 6, lash between a pushrod and rocker arm may be accommodated through the use of a sliding member disposed within the rocker arm. FIG. 7, illustrates an alternative embodiment of a pushrod assembly 700 to accommodate lash between the pushrod 402 and a valve train component (not shown) that receives valve actuation motions from the pushrod 402. In this instance, the pushrod assembly of FIG. 4 is once again provided in the form of a pushrod 402 having a retainer 408, resilient element 410 and fixed support 412 as described above. It is noted that the fixed support 412' in FIG. 7 is configured to include a vertical flange 412' that may be used to rigidly mount the fixed support 412. FIG. 7 further illustrates an opening 714 configured to permit passage of the pushrod 412, but not the resilient element 410, therethrough.

Figure 1:
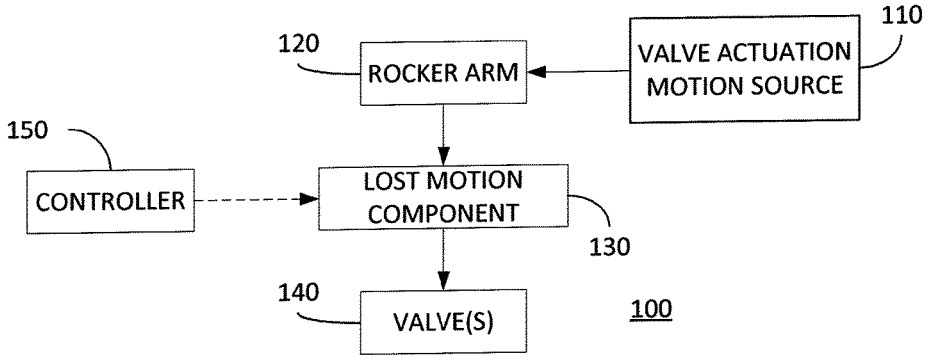
FIG. 1 is a block diagram schematically illustrating a valve actuation system in accordance with prior art techniques.
Figure 2:
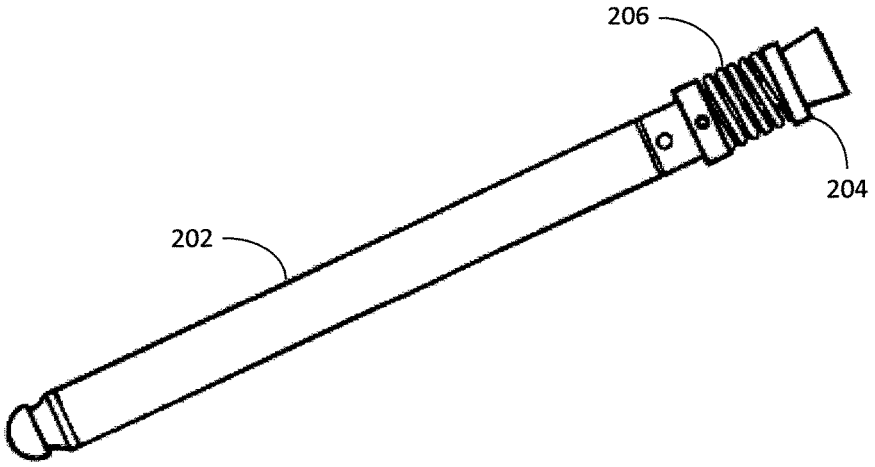
FIG. 2 is an illustration of a spring-loaded pushrod in accordance with prior art techniques.

As further shown, the pushrod assembly 700 includes a follower assembly comprising the pushrod sliding member 206 of FIG. 2 slidably disposed within a pushrod internal bore 716 at the second end 404 of the pushrod 402. A spring (or sliding member resilient element) 204 operatively engages the sliding member 206 at a first shoulder 724 integrally formed in the sliding member 206. Likewise, the spring 204 is also operatively connected to a second shoulder 718 integrally formed in the pushrod 402. Once again, it is noted that the first and second shoulders 724, 718, rather than being integrally formed in the sliding member 206 and pushrod 402, respectively, could instead be embodied by suitable components affixed to, but not otherwise integrally formed in, the sliding member 206 and pushrod 402. Regardless, configured in this manner, the spring 204 is compressed between the first and second shoulders 724, 718 thereby biasing the sliding member 206 out of the pushrod internal bore 716. As shown, in this implementation, the sliding member 206, shoulders 724, 718 and spring 204 are all configured to also pass through the opening 714 in the fixed support 412. However, this is not a requirement as the fixed support 412 could be positioned relatively more distally from the second end 404 of the pushrod 402 such that the reciprocal motion of the sliding member 206, shoulders 724, 718 and spring 204 do not need to be accommodated by the opening 714.

As further shown, the sliding member 206 may further comprise a receptacle or socket 722 to rotatably receive a corresponding coupling member of another valve train component as described above. Additionally, the sliding member 206 comprises a first contact surface 726 configured to engage with a complementary second contact surface 728 formed in the second end 404 of the pushrod 402. Thus, when lash between the pushrod assembly 700 and the valve train component arises, the sliding member 206 is biased toward the valve train component, thereby taking up the lash space. Conversely, movement of the pushrod 402 during valve lift motions sufficiently high to take up any existing lash causes the first and second contact surfaces 726, 728 to engage, thereby establishing a rigid interface between the pushrod 402 and sliding assembly 206. This rigid interface then permits the sliding member 206 to convey such motions from the pushrod 402 to the valve train component.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. An internal combustion engine comprising a valve actuation motion source for providing valve actuation motions to at least one engine valve via a rocker arm, wherein the rocker arm is biased toward the at least one engine valve, the internal combustion engine further comprising:

a pushrod having a first end configured to receive the valve actuation motions from the valve actuation motion source and a second end configured to impart the valve actuation motions to the rocker arm, the pushrod further comprising a resilient element engagement feature;

a fixed support; and a resilient element operatively connected to the resilient element engagement feature and the fixed support and biasing the pushrod, via the resilient element engagement feature, toward the valve actuation motion source, wherein the second end of the pushrod is in contact with the rocker arm via a follower assembly disposed in the rocker arm, the follower assembly comprising:

a sliding member having a second contact surface for engaging a complementary first contact surface of the rocker arm such that the valve actuation motions are conveyed from the pushrod to the rocker arm when the first and second contact surfaces are engaged; and a sliding member resilient element operatively connected to and biasing the sliding member toward the pushrod.

2. The internal combustion engine of claim 1, wherein the resilient element engagement feature is disposed proximally to the second end of the pushrod.

3. The internal combustion engine of claim 1, wherein the resilient element engagement feature comprises a retainer affixed to the pushrod.

4. The internal combustion engine of claim 1, wherein the resilient element comprises a coil spring surrounding the pushrod.

5. The internal combustion engine of claim 1, wherein the rocker arm comprises a bore and the sliding member is disposed in the bore, wherein the sliding member resilient element is operatively connected to the rocker arm.

6. The internal combustion engine of claim 5, the rocker arm comprising a first contact surface and the sliding member comprising a second contact surface complementary to the first contact surface, wherein engagement of the first contact surface and the second contact surface permits the valve actuation motions to be conveyed to the rocker arm.

7. The internal combustion engine of claim 1, wherein the rocker arm comprises a bore and the follower assembly further comprises:

an adjustable housing disposed within the bore and having an internal bore, wherein the sliding member is disposed within the internal bore and wherein the sliding member resilient element is operatively connected to the adjustable housing.

8. The internal combustion engine of claim 7, the adjustable housing comprising a first contact surface and the sliding member comprising a second contact surface complementary to the first contact surface, wherein engagement of the first contact surface and the second contact surface permits the valve actuation motions to be conveyed to the rocker arm.

9. The internal combustion engine of claim 1, wherein the sliding member resilient element is configured to bias the rocker arm away from the pushrod.

10. An internal combustion engine comprising a valve actuation motion source for providing valve actuation motions to at least one engine valve via a rocker arm, wherein the rocker arm is biased toward the at least one engine valve, the internal combustion engine further comprising:

a pushrod having a first end configured to receive the valve actuation motions from the valve actuation motion source and a second end configured to impart the valve actuation motions to the rocker arm, the pushrod further comprising a resilient element engagement feature;

a fixed support; and a resilient element operatively connected to the resilient element engagement feature and the fixed support and biasing the pushrod, via the resilient element engagement feature, toward the valve actuation motion source, wherein the second end of the pushrod is in contact with the rocker arm via a follower assembly disposed in the second end of the pushrod, the follower assembly comprising:

a sliding member having a second contact surface for engaging a complementary first contact surface of the pushrod such that the valve actuation motions are conveyed from the pushrod to the rocker arm when the first and second contact surfaces are engaged; and a sliding member resilient element operatively connected to and biasing the sliding member toward the rocker arm.

11. The internal combustion engine of claim 10, wherein the pushrod comprises a bore and the sliding member is disposed in the bore, wherein the sliding member resilient element is operatively connected to the pushrod.

12. The internal combustion engine of claim 10, the pushrod comprising a first contact surface and the sliding member comprising a second contact surface complementary to the first contact surface, wherein engagement of the first contact surface and the second contact surface permits the valve actuation motions to be conveyed to the rocker arm.

13. The internal combustion engine of claim 10, wherein the resilient element engagement feature is disposed proximally to the second end of the pushrod.

14. The internal combustion engine of claim 10, wherein the resilient element engagement feature comprises a retainer affixed to the pushrod.

15. The internal combustion engine of claim 10, wherein the resilient element comprises a coil spring surrounding the pushrod.

* * * * *